US009474922B2

(12) United States Patent
Magrella

(10) Patent No.: US 9,474,922 B2
(45) Date of Patent: Oct. 25, 2016

(54) COMBINATION EXERCISE MACHINE FOR PERFORMING PILATES AND BARRE WORKOUTS

(71) Applicant: Jean Magrella, Lake Worth, FL (US)

(72) Inventor: Jean Magrella, Lake Worth, FL (US)

( * ) Notice: Subject to any disclaimer, the term of this patent is extended or adjusted under 35 U.S.C. 154(b) by 117 days.

(21) Appl. No.: 14/081,672

(22) Filed: Nov. 15, 2013

(65) Prior Publication Data

US 2015/0141218 A1 May 21, 2015

(51) Int. Cl.

| | |
|---|---|
| ***A63B 21/00*** | (2006.01) |
| ***A63B 21/002*** | (2006.01) |
| ***A63B 21/02*** | (2006.01) |
| ***A63B 21/04*** | (2006.01) |
| ***A63B 22/00*** | (2006.01) |
| ***A63B 23/04*** | (2006.01) |

(52) U.S. Cl.

CPC ..... *A63B 21/04* (2013.01); *A63B 21/0023* (2013.01); *A63B 21/00065* (2013.01); *A63B 21/023* (2013.01); *A63B 21/0428* (2013.01); *A63B 21/4023* (2015.10); *A63B 21/4029* (2015.10); *A63B 21/4031* (2015.10); *A63B 21/4033* (2015.10); *A63B 22/0056* (2013.01); *A63B 2023/0411* (2013.01); *A63B 2208/0204* (2013.01); *A63B 2208/0228* (2013.01); *A63B 2210/50* (2013.01)

(58) Field of Classification Search

CPC ..... A63B 21/02; A63B 21/023–21/025; A63B 21/04–21/0435; A63B 21/1457–21/1461; A63B 2021/1609; A63B 2210/02; A63B 2210/50; A63B 21/00123–21/00127; A63B 21/1492–21/1496

See application file for complete search history.

(56) References Cited

U.S. PATENT DOCUMENTS

| | | | | |
|---|---|---|---|---|
| 5,277,684 | A * | 1/1994 | Harris | 482/130 |
| 6,220,995 | B1 * | 4/2001 | Chen | 482/140 |
| 2009/0105054 | A1 * | 4/2009 | Boland et al. | 482/140 |
| 2009/0227434 | A1 * | 9/2009 | Baudhuin | 482/130 |
| 2009/0264266 | A1 * | 10/2009 | Solow et al. | 482/130 |

* cited by examiner

*Primary Examiner* — Oren Ginsberg
*Assistant Examiner* — Jennifer M Deichl
(74) *Attorney, Agent, or Firm* — McHale & Slavin P.A.

(57) ABSTRACT

An apparatus for performing a plurality of both Pilates and Barre exercises is described. The apparatus comprises a first component comprising a top wall defining an upper surface, a bottom wall defining a bottom surface, a plurality of side walls interconnected to provide a partially enclosed structure. Each of the side walls connect the top surface to the bottom surface whereby the upper surface is positioned at a vertical distance from the bottom wall. A second component comprises opposing, vertically directed members secured to different side walls of the first component, and a horizontally directed member having a first end secured to one of the vertically directed members and a second end secured to the opposing vertically directed members. Each opposing, vertically directed member have a resistance member providing flexibility while imparting resistance when one or more portions of the second component is bent or flexed.

16 Claims, 24 Drawing Sheets

COMBINATION EXERCISE MACHINE FOR PERFORMING PILATES AND BARRE WORKOUTS

FIELD OF THE INVENTION

The present invention is directed towards exercise equipment, to exercise equipment directed to the field of Pilates and Ballet Barre (Barre) procedures; and more particularly to a combination Pilates-Barre device that can be used to perform both Pilates and Barre exercises.

BACKGROUND OF THE INVENTION

Improved understanding of disease and how the body works has resulted in the increases in longevity. As such, more and more individuals strive to incorporate some type of exercise into their daily routine. One type of exercise seeing increased popularity is Pilates exercises. While Pilates is enjoying resurgence in popularity, the exercise system was actually invented in the late 1920s by Joseph Pilates. The method was designed to allow users the ability to develop controlled movement from a strong core using a range of apparatus/exercises to guide and train the body. Typical Pilates equipment includes the reformer, a horizontally positioned frame having a movable carriage. The device allows for a user to perform a variety of exercises. U.S. Patent Publication No. 2012/0202661 is an example of a Pilates reformer. One of the disadvantages of these types of exercise machines is that they are large, hard to move, and are oriented in a horizontal manner, which requires large amounts of open space.

In addition to Pilates exercises, Barre exercise using a Ballet Barre is also gaining popularity. These exercises integrate a fat-burning format of interval training with muscle-shaping isometrics to quickly and safely reshape the entire body. The exercises are designed to help strengthen muscles, increase extension, improve flexibility and help with balance. Combining Pilates exercises with Barre exercises provides an effective exercise regimen.

SUMMARY OF THE INVENTION

The present invention is directed towards a device for performing a plurality of both Pilates and Barre exercises. The exercise equipment apparatus for performing multiple exercise workouts in a single apparatus comprises a first component adapted for providing a plurality of Pilates type exercises and a second component adapted for providing a user a plurality of Barre exercises. In one embodiment, the exercise equipment apparatus comprises a first component comprising a top wall defining an upper surface, a bottom wall defining a bottom surface, a plurality of side walls connecting the top wall and bottom wall to provide a partially enclosed structure. Each of the side walls connecting the top surface to the bottom surface whereby the upper surface is positioned at a vertical distance from the bottom wall. The apparatus comprises a second component for performing a second set of exercises whereby the second set of exercises being different from the first set of exercises. The second component comprising opposing, vertically directed members secured to different side walls of the first component, and a horizontally directed member having a first end secured to one of the vertically directed members and a second end secured to the opposing vertically directed member. Each opposing, vertically directed member have a resistance component or member providing flexibility while imparting resistance when one or more portions of the second component is bent or flexed.

The exercise equipment apparatus is designed to be used in a home or studio setting. Preferably, it uses springs for resistance and/or assistance for each of the exercises and allows users to create a primary and secondary powerhouse connection for a strong core and good posture.

Accordingly, it is an objective of the present invention to provide an exercise equipment apparatus designed to allow a user to perform multiple exercises.

It is a further objective of the present invention to provide an exercise equipment apparatus designed to allow a user to perform multiple Pilates exercises.

It is yet another objective of the present invention to provide an exercise equipment apparatus designed to allow a user to perform multiple Barre exercises.

It is a still further objective of the invention to provide an exercise equipment apparatus designed to allow a user to perform Pilates and Barre exercises using a single apparatus.

It is a further objective of the present invention to provide an exercise equipment apparatus designed to allow a user to perform Pilates and Barre exercises using a single apparatus which utilizes less than three feet of space.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
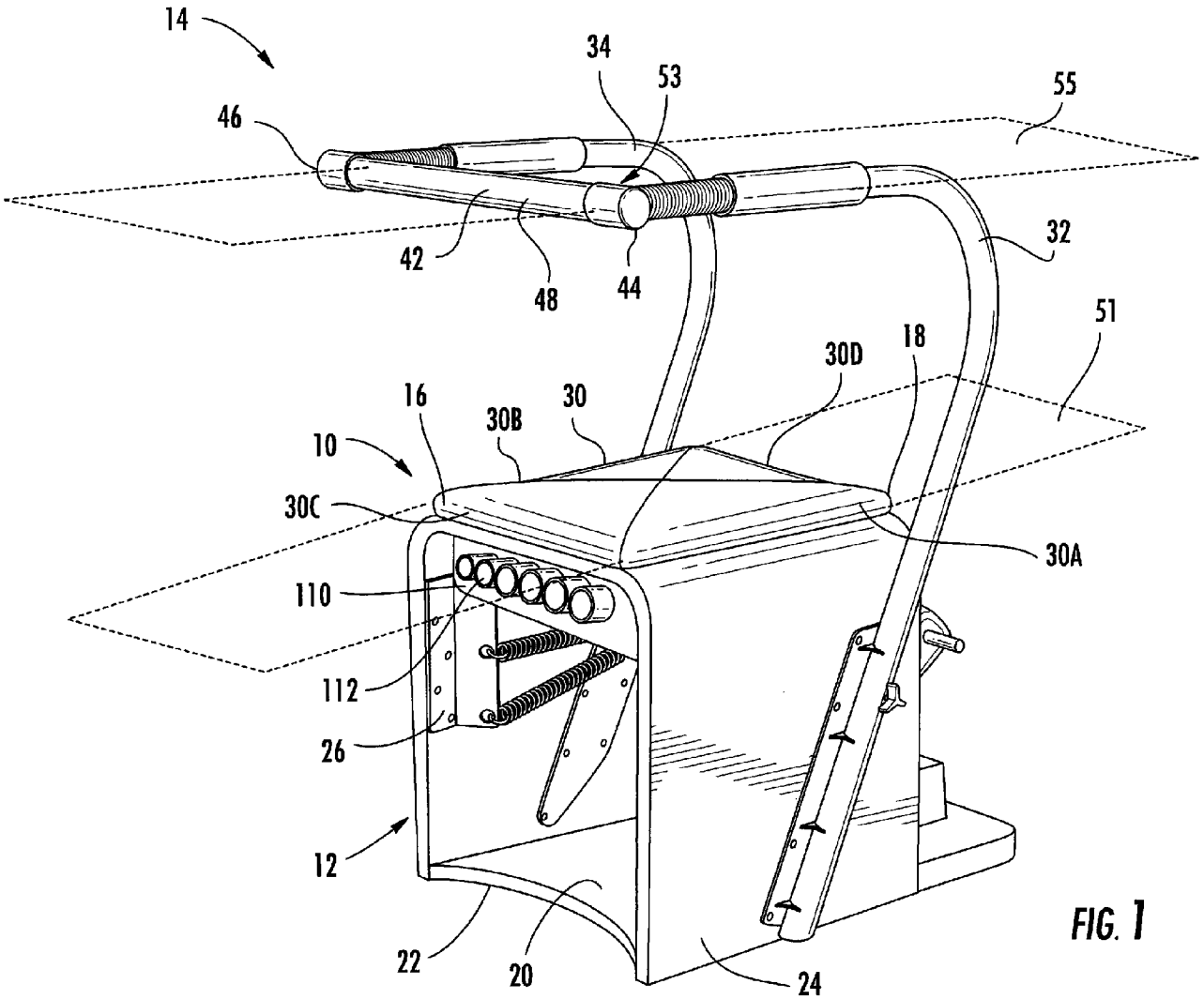
FIG. 1 is a side perspective view of an illustrative embodiment of a Pilates-Barre exercise device.
Figure 2:
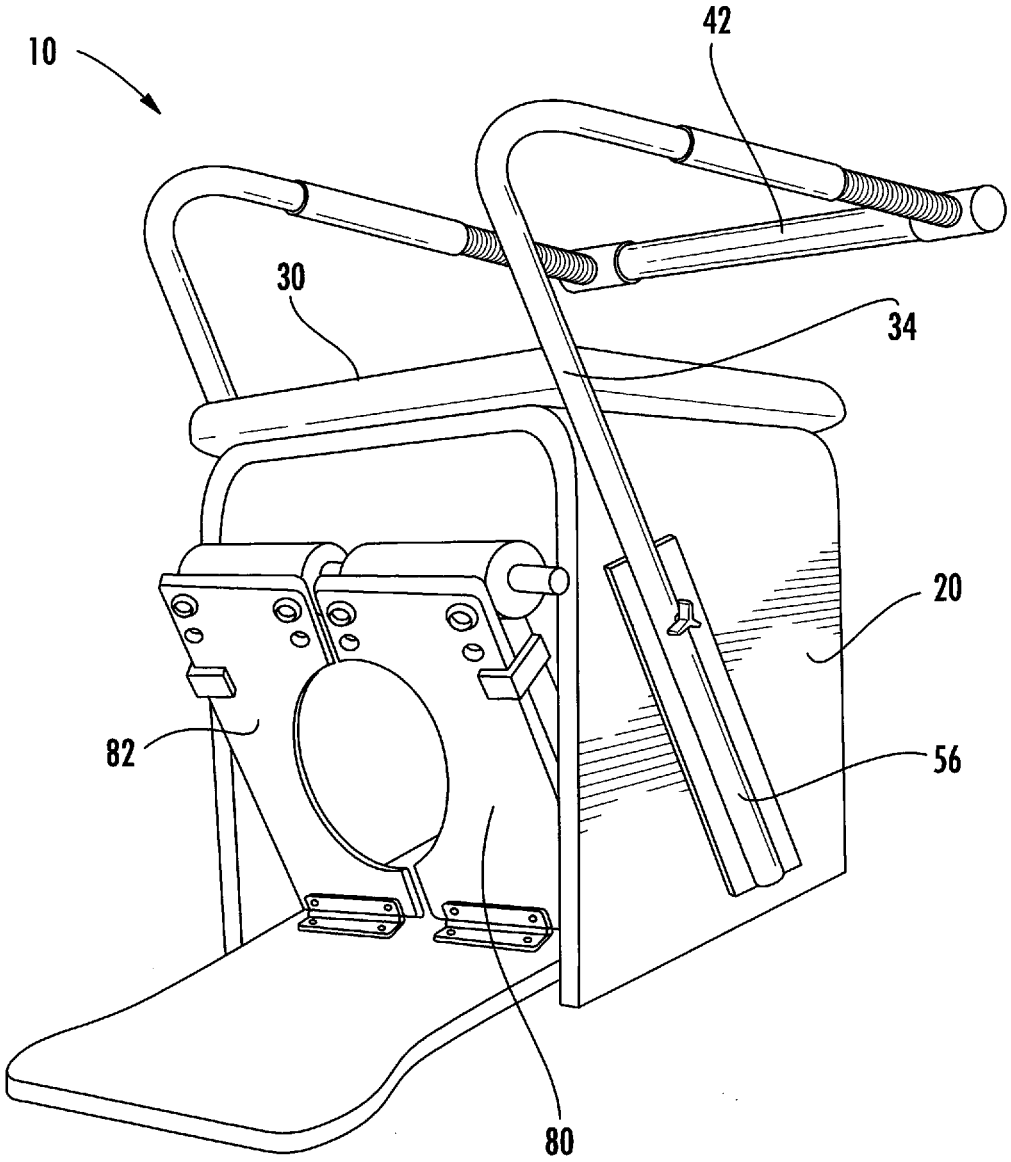
FIG. 2 is an alternative side perspective view of the Pilates-Barre exercise device.
Figure 3:
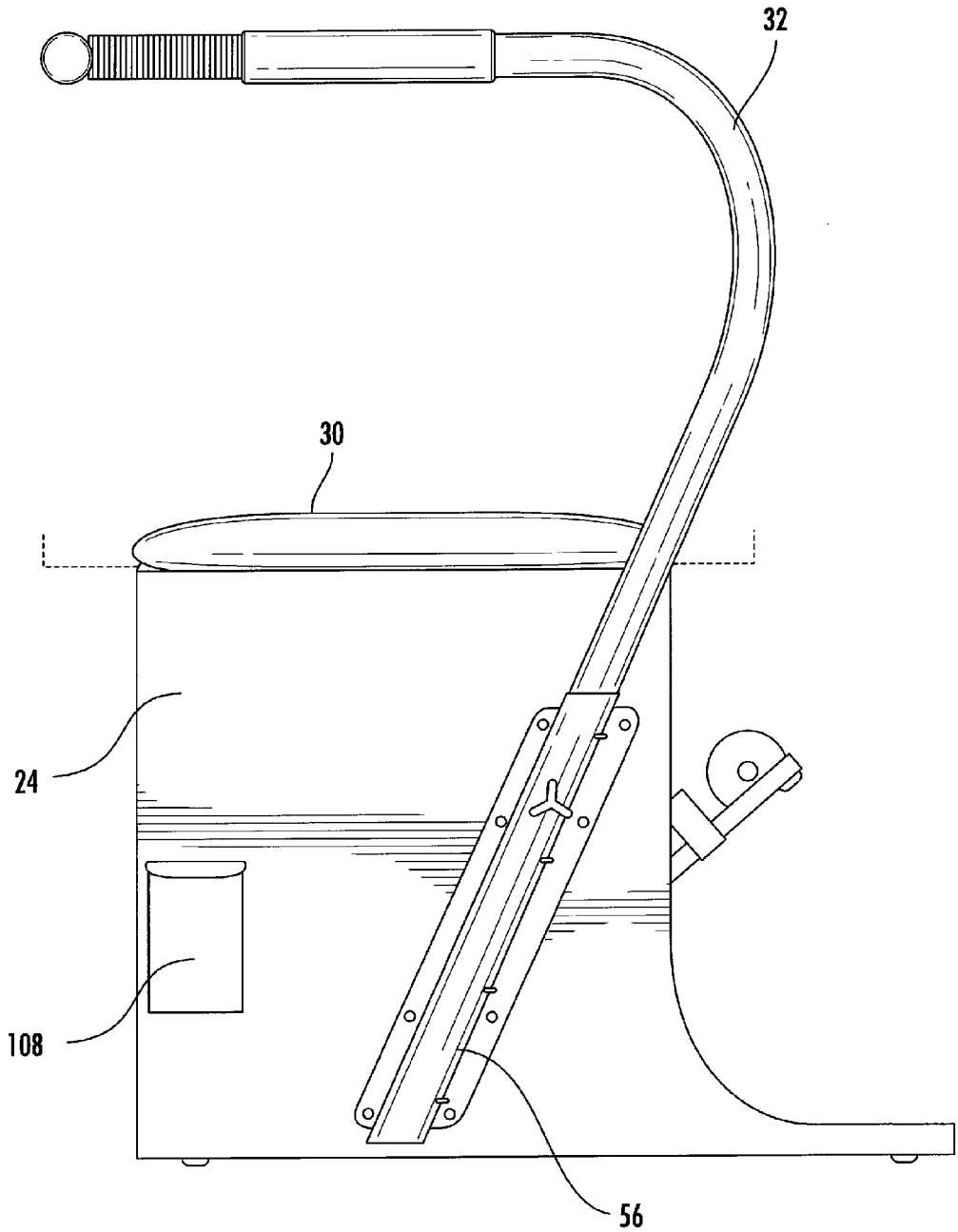
FIG. 3 is a left side view of the Pilates-Barre exercise device.
Figure 4:
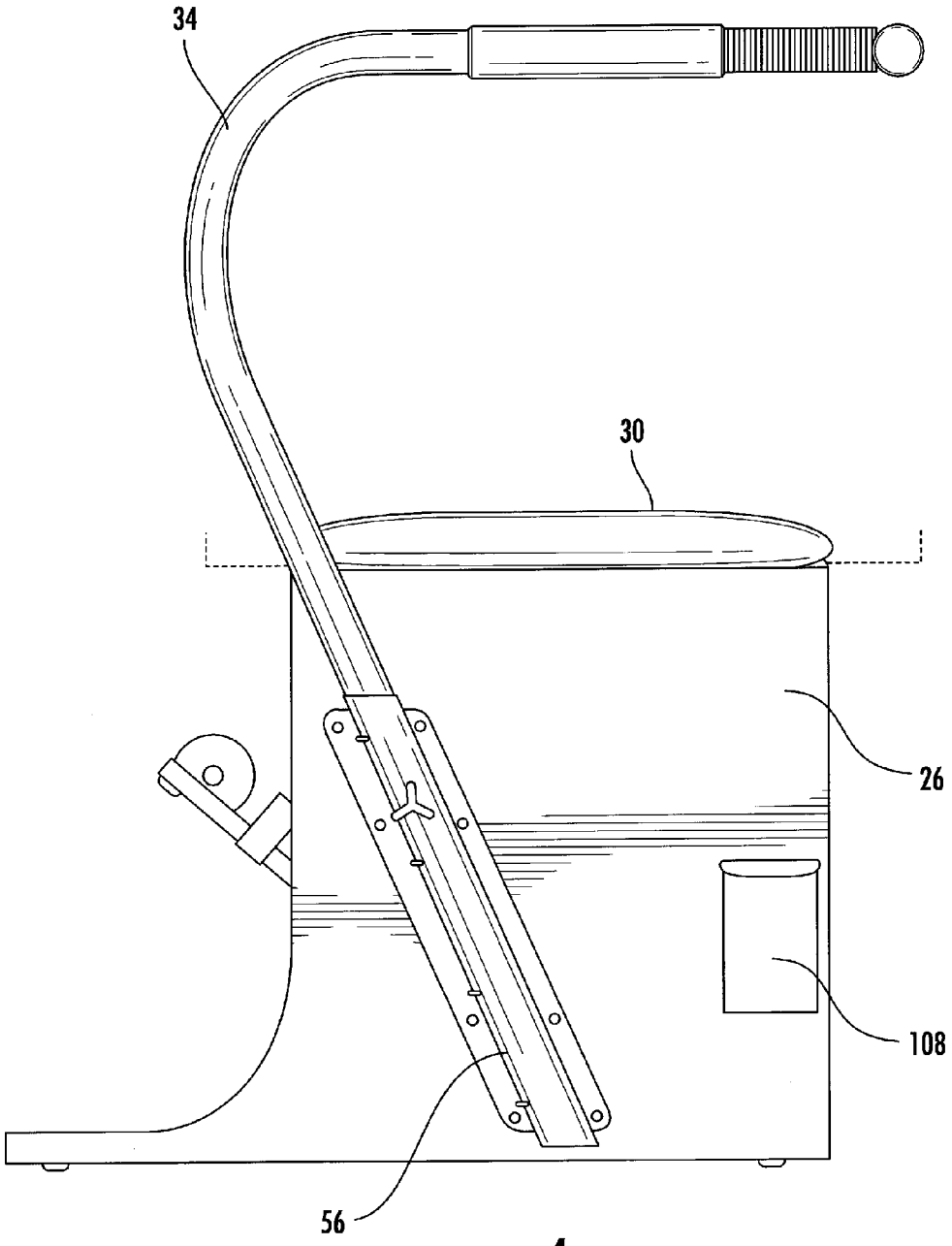
FIG. 4 is a right side view of the Pilates-Barre exercise device.
Figure 5:
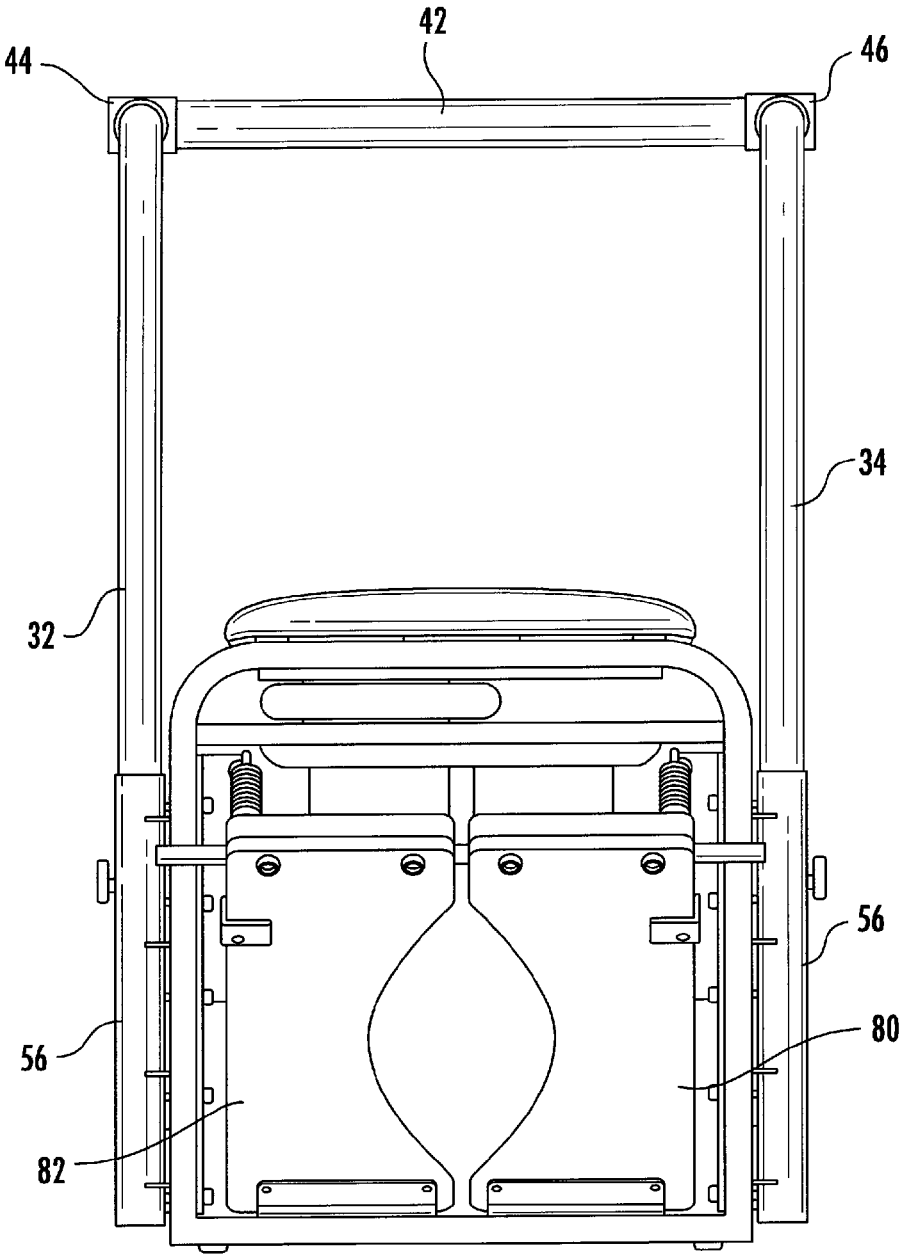
FIG. 5 is a front view of the Pilates-Barre exercise device.
Figure 6:
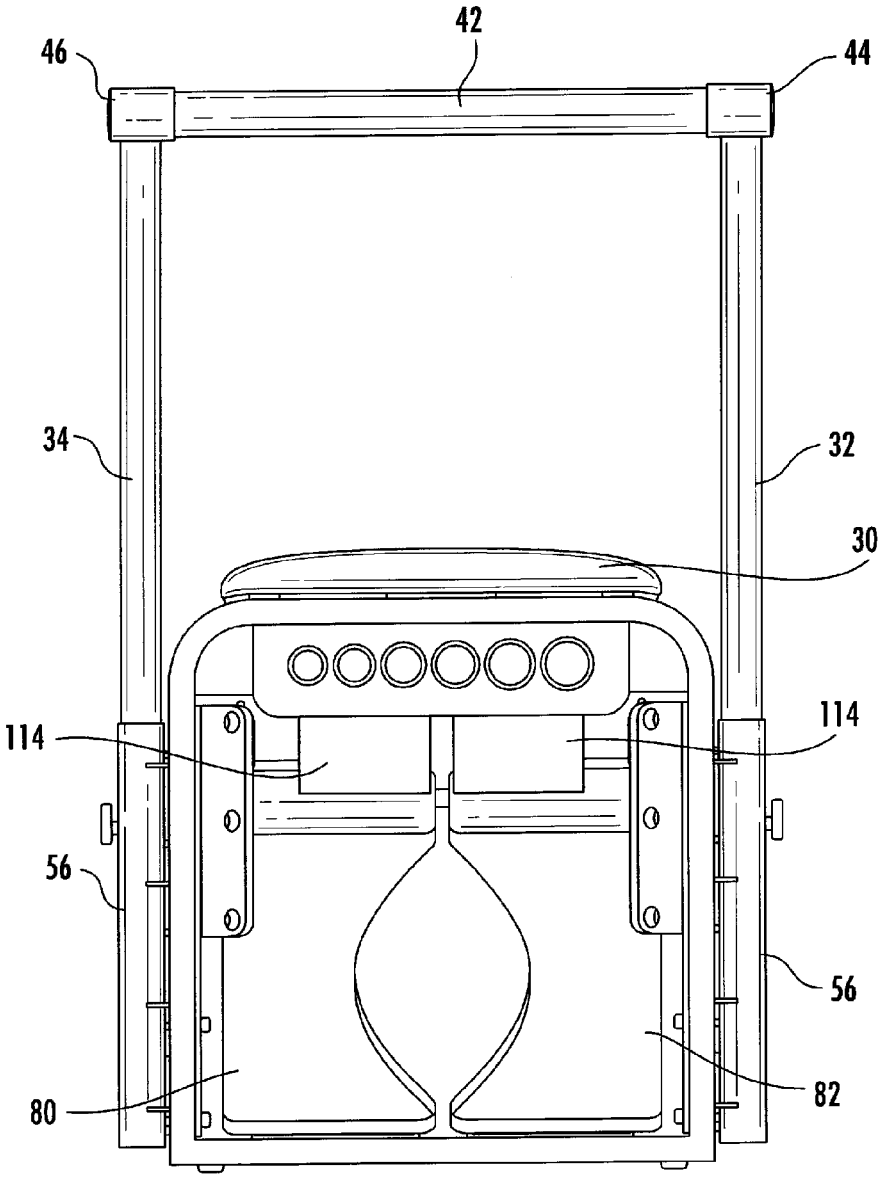
FIG. 6 is a back view of the Pilates-Barre exercise device.
Figure 7:
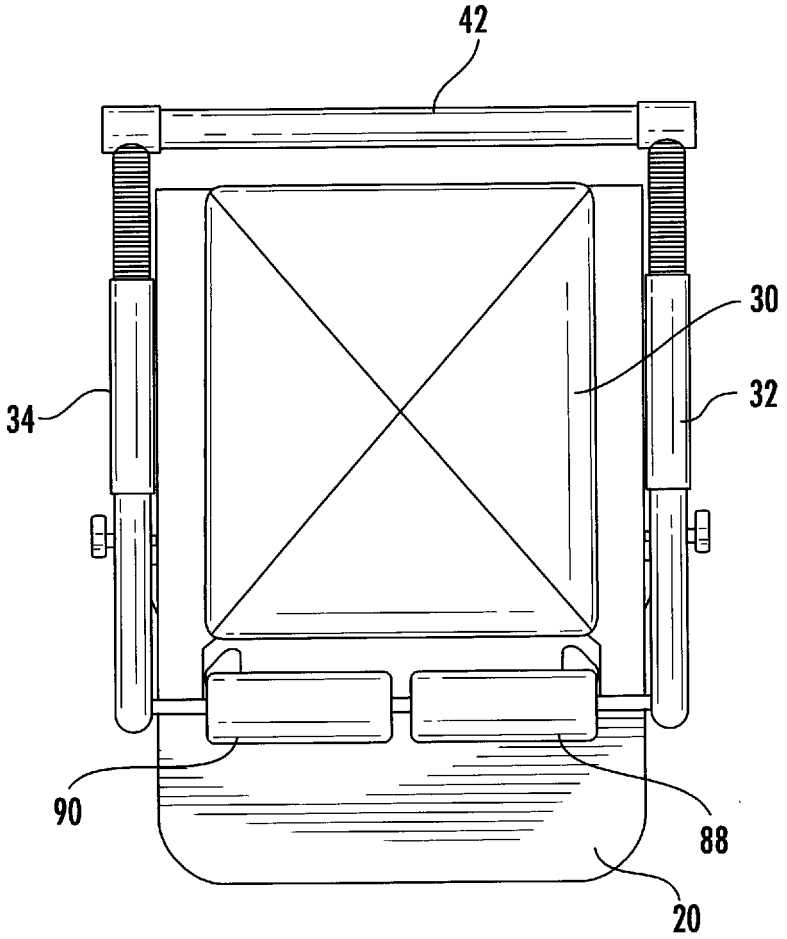
FIG. 7 is a top view of the Pilates-Barre exercise device.
Figure 8:
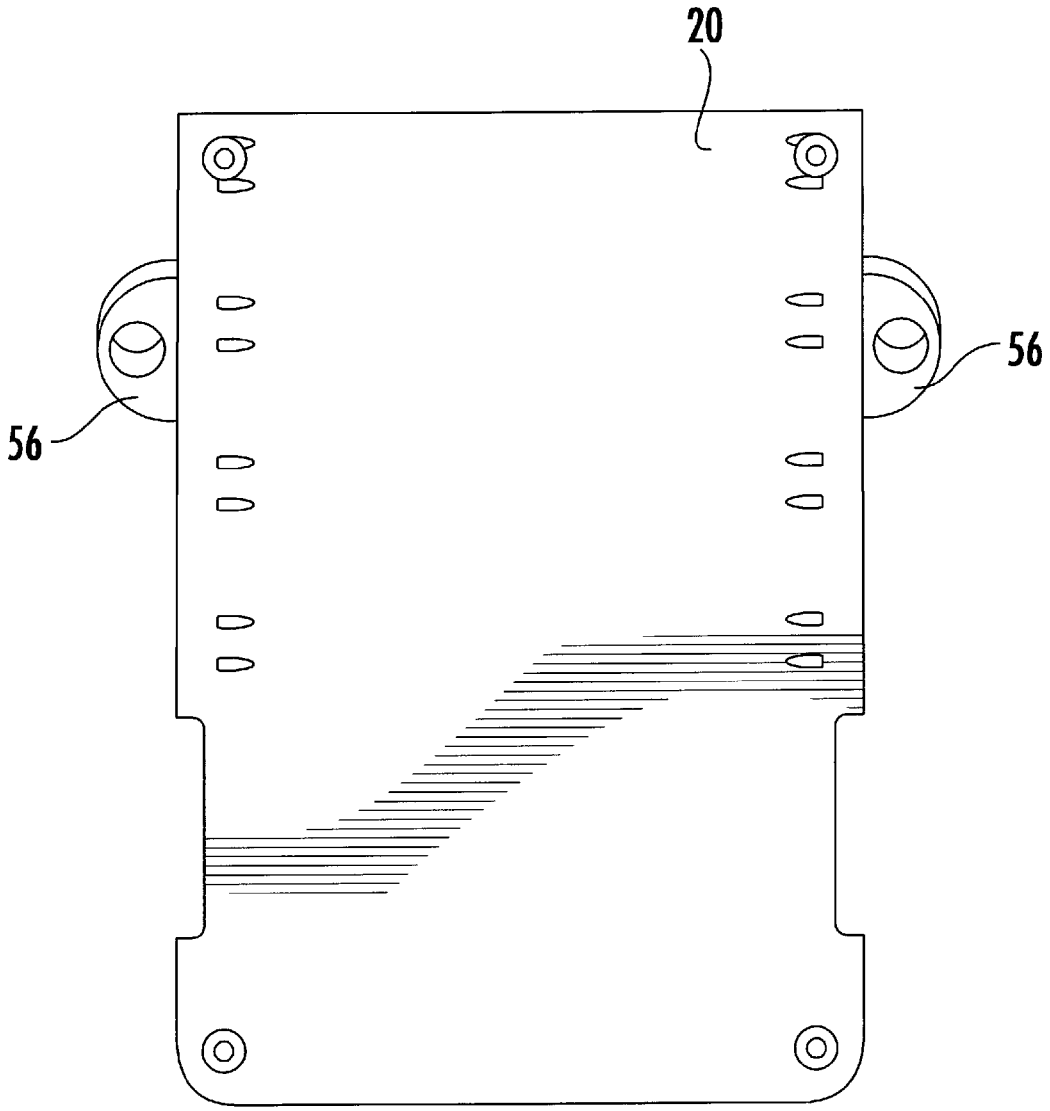
FIG. 8 is a bottom view of the Pilates-Barre exercise device.
Figure 9:
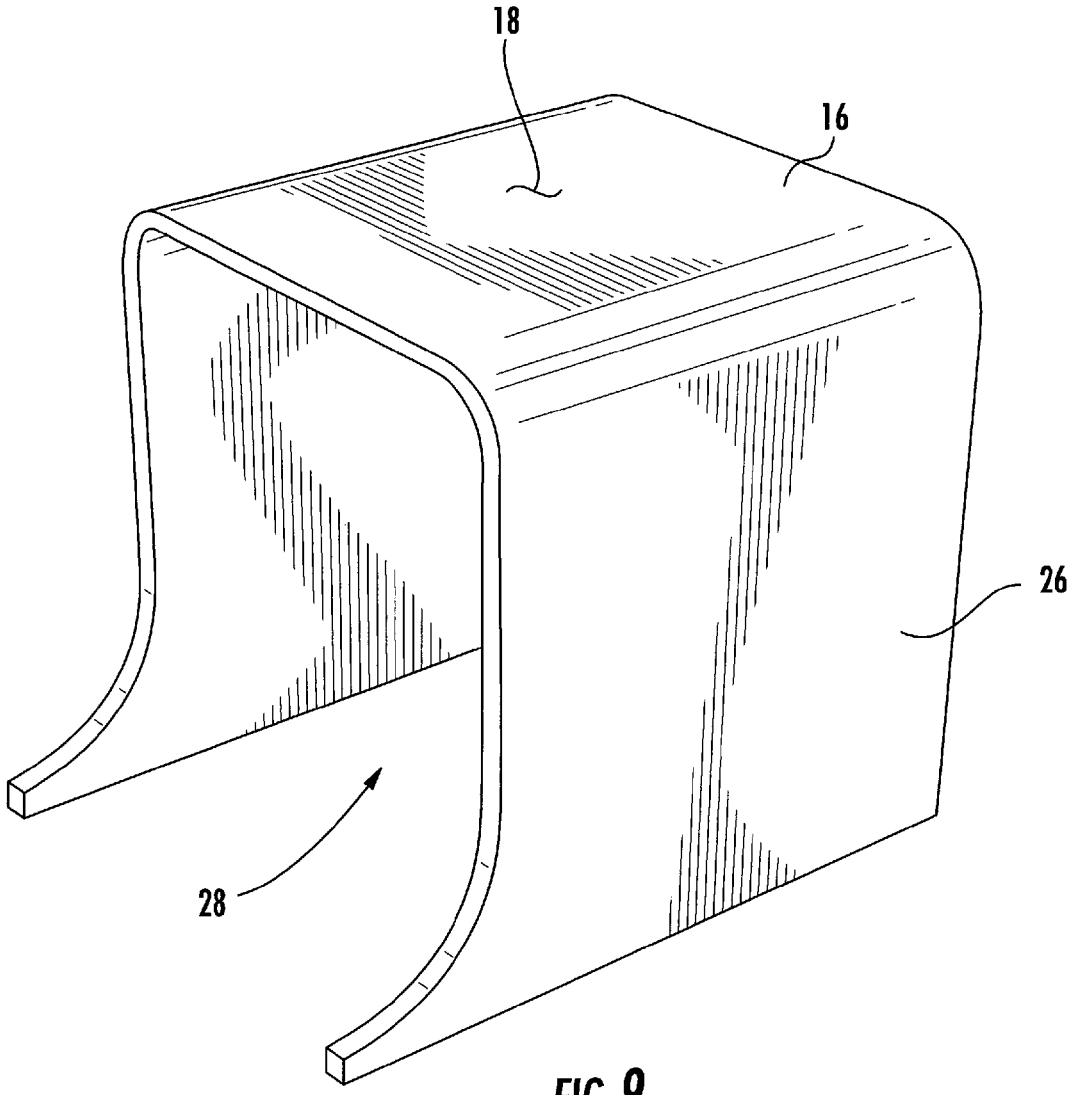
FIG. 9 illustrates an embodiment of the first component shown without the bottom wall.
Figure 10:
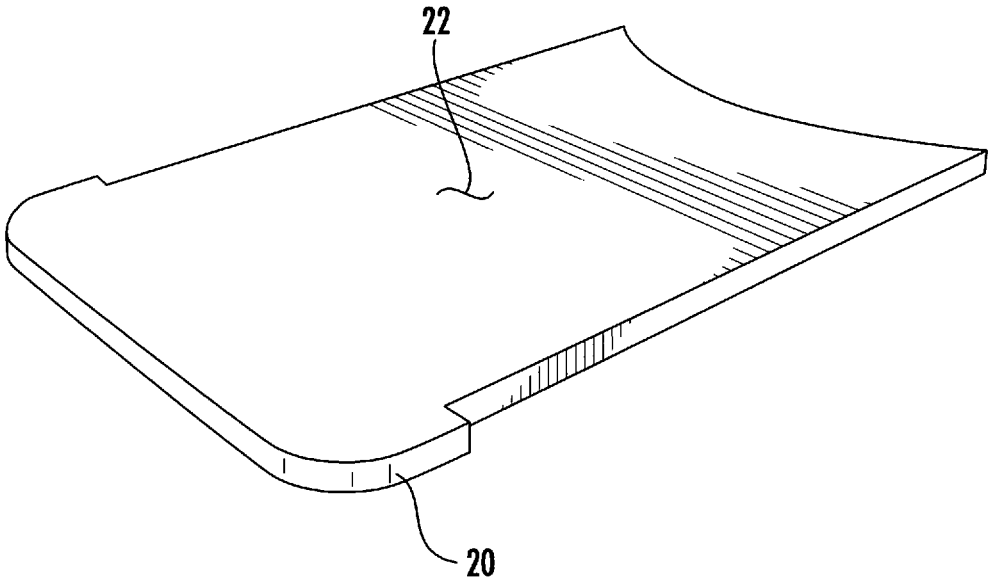
FIG. 10 is an embodiment of a bottom wall of the first component.
Figure 11:
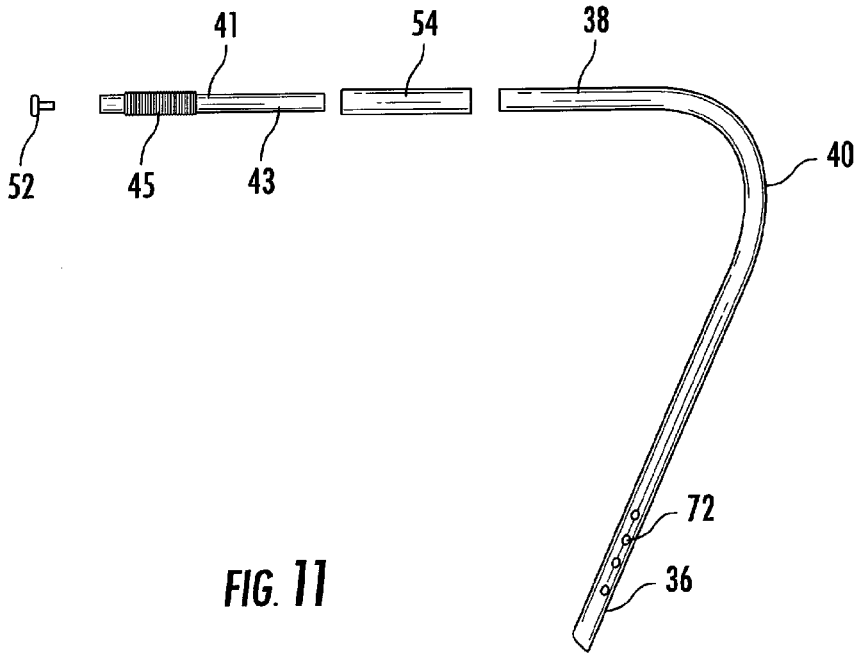
FIG. 11 illustrates one embodiment of a vertical member of the second component.
Figure 12:
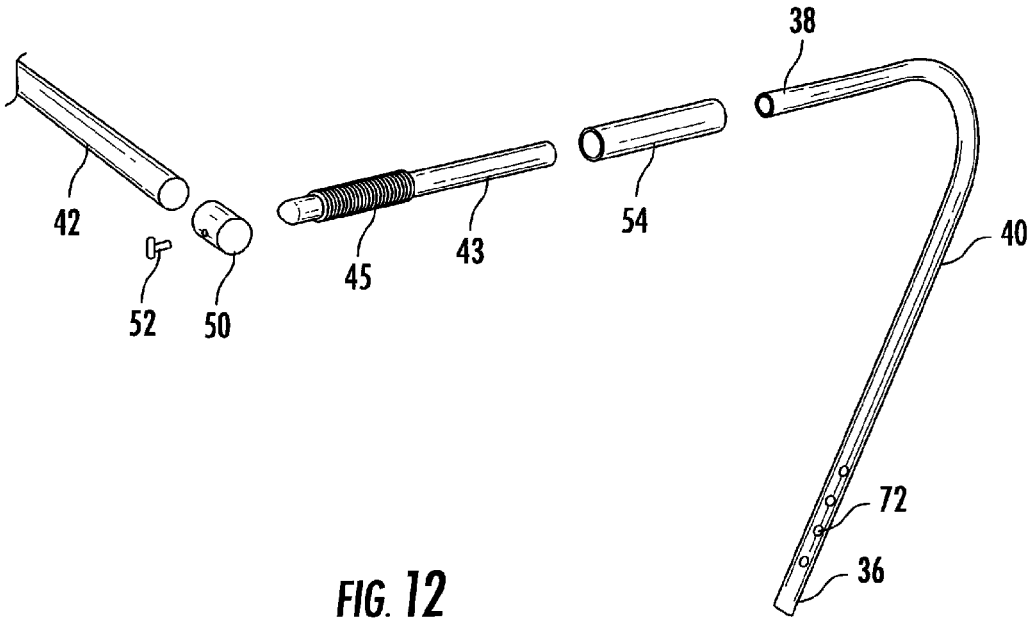
FIG. 12 is an exploded view of the vertical member of the second component.
Figure 13:
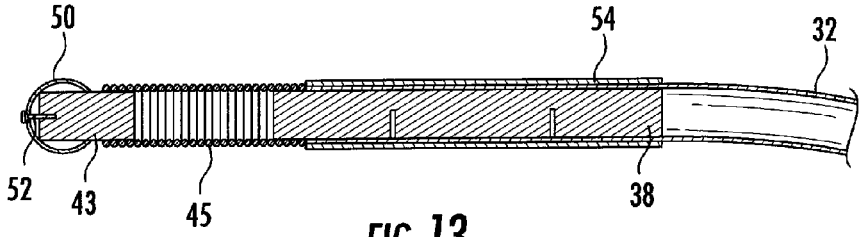
FIG. 13 is a cross-sectional view of the vertical member of the second component.
Figure 14:
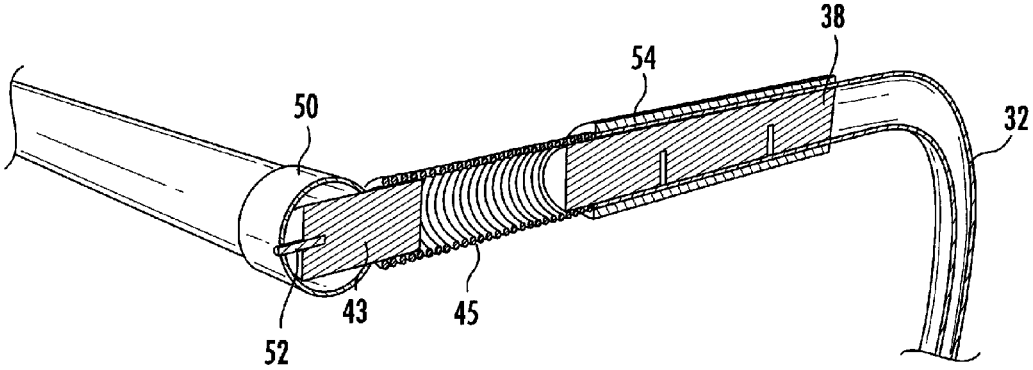
FIG. 14 is a cross-sectional view of the vertical member of the second component secured to the horizontal member.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 25:
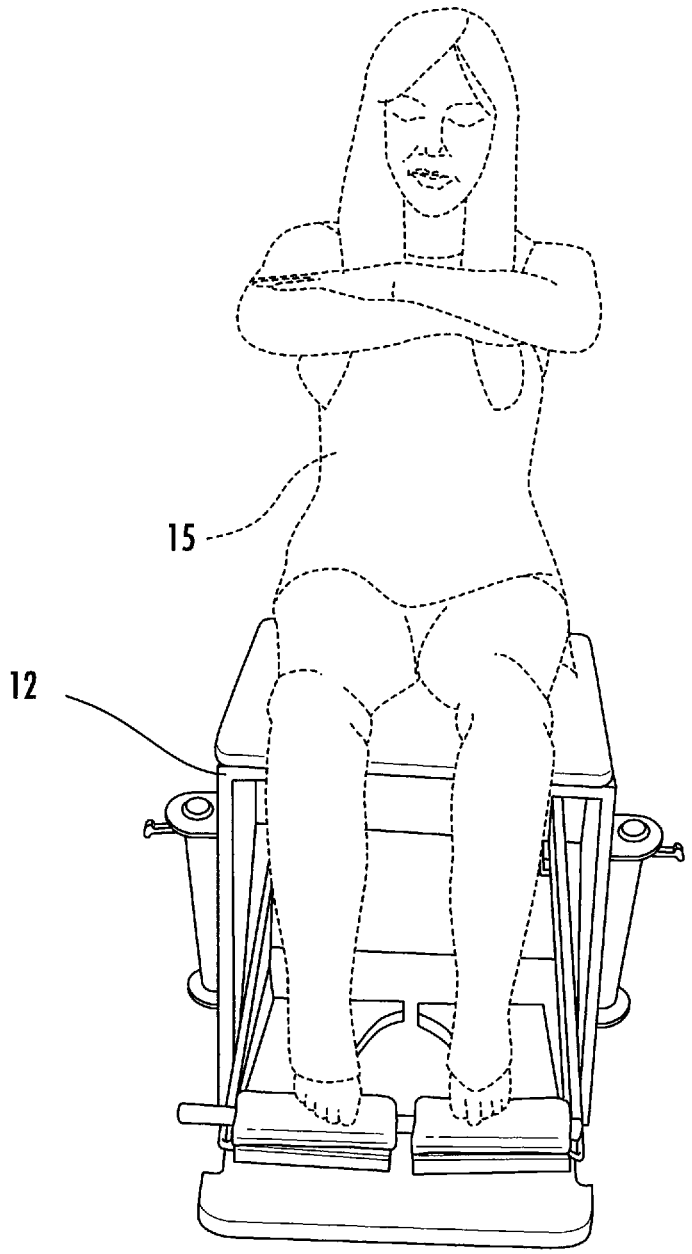
FIG. 25 illustrates an individual engaging the Pilates-Barre exercise device shown performing a Pilates exercise.
Figure 26:
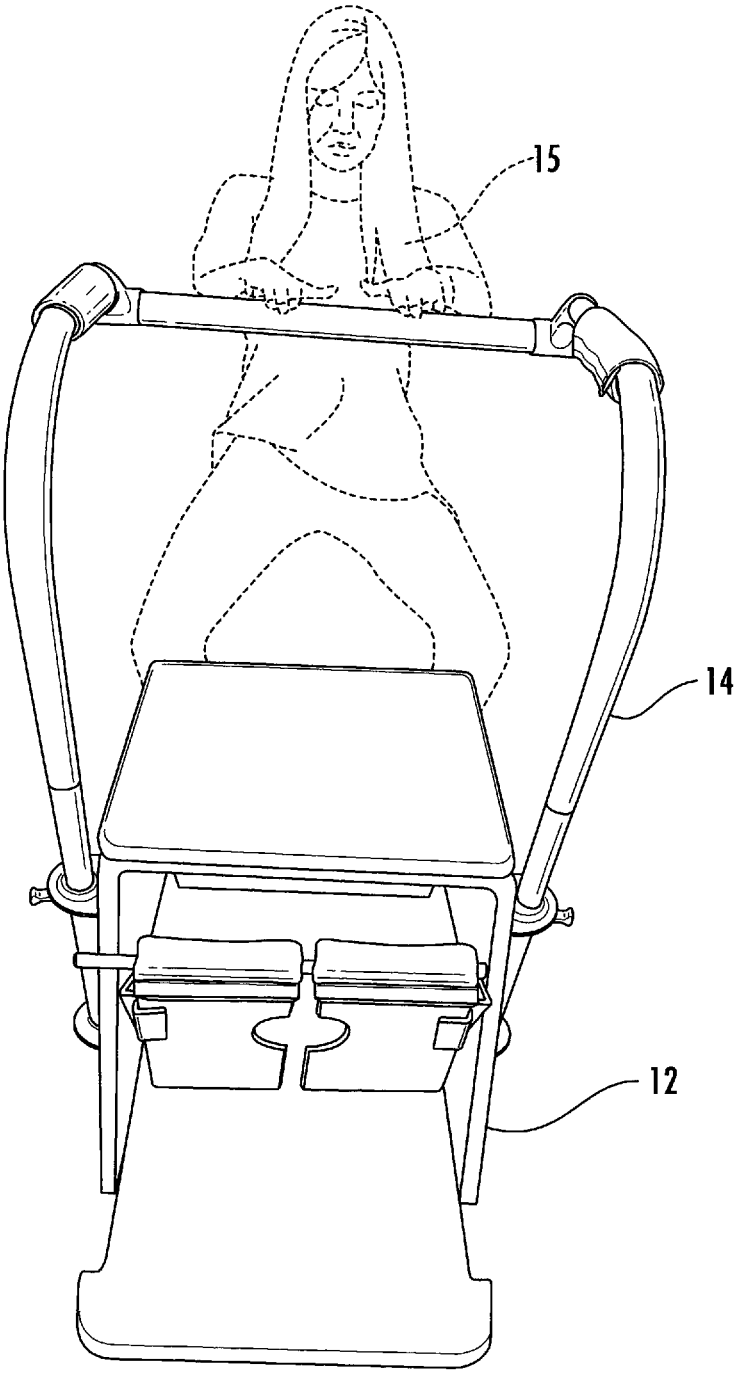
FIG. 26 illustrates an individual engaging the Pilates-Barre exercise device shown performing a Barre exercise.

Referring to FIGS. 1-10, an illustrative embodiment of an exercise equipment apparatus for performing multiple exercise workouts in a single apparatus, referred to generally as a Pilates-Barre exercise device 10, is shown. The Pilates-Barre exercise device 10 is designed to allow for multiple exercises, allowing a user to perform Pilates (see individual 15, FIG. 25) and Barre (see individual 15, FIG. 26) workouts in a single apparatus. The Pilates-Barre exercise device 10 includes a first component 12 adapted to primarily provide Pilates exercises, and a second component 14 adapted to provide Barre exercises. While the first component can be any size, Pilates-Barre exercise device 10 can be designed to take up less than three feet of floor space. The Pilates-Barre exercise device first component 12 is illustrated as a Pilates chair having a top wall 16 defining an upper surface 18, a bottom wall 20 defining a lower surface 22. The upper surface 18 is preferably sized and shaped to receive a portion of a user's body.

A plurality of side walls 24 and 26 separate the top wall 16 and the bottom wall 20 and provide a predetermined height from a surface, i.e. a floor, in which the Pilates-Barre exercise device 10 rests there upon. The top wall 16, the bottom wall 20, and the plurality of side walls 24 and 26 define a partially open vertical structure having an interior 28, FIG. 9. Secured to the upper surface 18 is a cushion 30. The cushion is preferably may be integrally formed to the upper wall 16. Alternatively, the cushion 30 may be removeably secured to the upper wall 16 so that the cushion 30 can be easily removed for cleaning purposes or removal for wear and tear. The cushion 30 may be secured to the upper wall 16 using mechanisms known to one of skill in the art, including but not limited to, using securing members such as screws or loop and fastening mechanisms such as VELCRO.

Attached to the walls 24 and 26 of the first component 12 is the second component 14, illustrated as a modified ballet barre. The second component comprises a pair of opposing vertical members, illustrated herein as support bars 32 and 34. Referring to FIGS. 11-14, the first vertical member 32 is illustrated. The first vertical member 32 contains a first end 36, a second end 38, and a main body 40 there between. A portion of the first end 36 attaches or couples to the first component wall 24 either directly or indirectly using securing mechanism to be described later.

The main body 40 may be made of a single unit, or may be made of several telescoping units. Positioned within or coupled to the second end 38 is a resistance member assembly 41 constructed and arranged to provide resistance when a user engages the second component 14. The resistance member assembly 41 provides for a portion of the vertical bars 32 or 34 to be flexible while imparting a resistance when the portion is flexed or bent during an exercise movement. Preferably, the resistance member assembly 41 comprises a resistance member assembly bar 43 having a coil spring 45 of a predetermined resistance. Alternatively, resistance may be provided by using alternative spring members such as an expansion spring or cantilever spring or by using various materials that can provide resistance as a user presses or pushes against it, including but not limited to high density rubber, SS steel cables in a braid, flexible plastics, such as polymers, or flexible vinyl such as GEON. The second vertical member 34 is constructed in the same manner as the first vertical member 32. Accordingly, the components described for the first vertical member 32 are applicable to the second vertical member 34, with the difference being that the second vertical member 34 secures to the side wall 26.

Figure 15A:
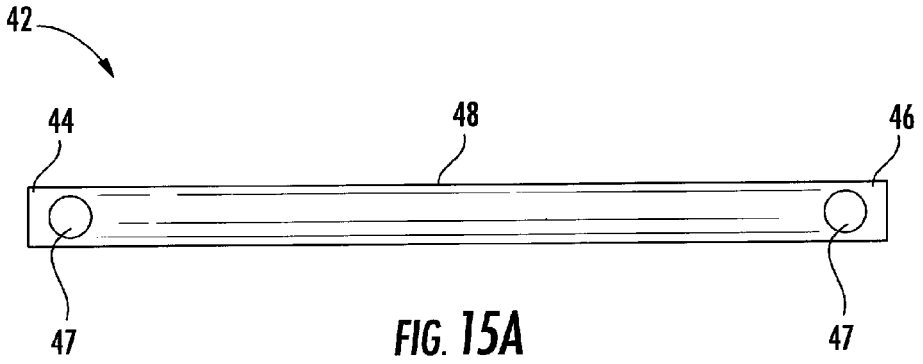
FIG. 15A is a side view of an illustrative example of the horizontal member.
Figure 15B:
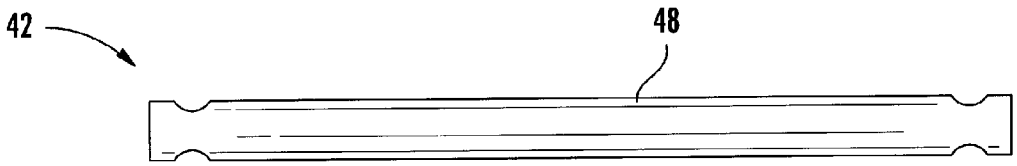
FIG. 15B is a top view of the horizontal member illustrated in FIG. 15A.
Figure 15C:
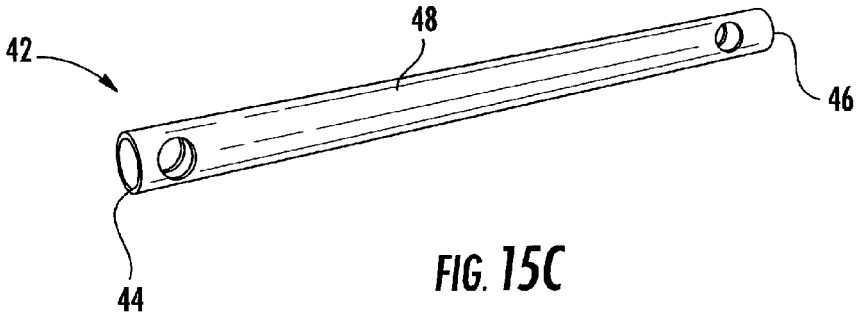
FIG. 15C is a top perspective view of the horizontal member illustrated in FIG. 15A.

Connecting the first vertical member 32 and the second vertical member 34 is a horizontally directed member, illustrated as a cross bar 42, see also FIGS. 15A-15B. The horizontally directed member 42 comprises a first end 44 secured to the vertically directed member 32, a second end 46 secured to the opposing vertically directed member 34, and a horizontally directed member main body 48. Each of the ends 44 and 46 contains an opening 47 sized and shaped to receive one vertical member 32 or 34. The second component is preferably constructed to be positioned in a plane parallel to and above the top wall 16 with the portions of the vertical members 32, 34 and the horizontal bar 42 arranged to align or contour with portions of the perimeter of the top wall 16.

The vertically directed members 32, 34 and the horizontally directed member 42 may be made as a single unit. Alternatively, the horizontally directed member 42 may be secured to the support bars 32, 34 through collars 50 and screws 52, see FIG. 14 as well. Providing support bars 32, 34 which are connectable to the horizontal member 42 as separate, individual units allows the second component 14 to be easily assembled and/or disassembled during shipping. In addition, should the user desire to use the first component 12 without the second component 14 being attached, the second component can be removed and reassembled easily. In addition, the user may replace one resistance member assembly 41 having a spring coil 45 with a predetermined resistance with another coil spring 45 having increased/decreased resistance. Each of the support bars 32 and 34 may include a handle grip 54.

In a preferred embodiment, the support bars 32 and 34 are positioned to orientate at least a portion of each corresponding second end 38, including the resistance member assembly 41, handle grip 54, and the horizontal bar 42 above and/or in parallel orientation of seat 30 or from a plane 51 that extends out from seat 30. Accordingly, the resistance member assembly 41, handle grip 54, and the horizontal bar 42 of support bar 32 mirror, contour, or are aligned with, i.e. in a parallel manner and above, the outer perimeter or edge 30A of the seat 30. The resistance member assembly 41, handle grip 54, and the horizontal bar 42 of support bar 34 mirror, contour, or are aligned with, i.e. in a parallel manner and above, the outer perimeter or edge 30B of the seat 30. The horizontal bar 42 mirrors, contours or aligns with, i.e. in a parallel manner and above, the outer perimeter or edge 30C of the seat 30. Open area 53 is aligned with the outer perimeter or edge 30D of the seat 30. If seat 30 is not used, the resistance member assembly 41, handle grip 54, and the horizontal bar 42 may align with the outer perimeter or edges of surface 16. In either orientation, the a portion of the second component 14 forms a plane 55 arranged above and in a parallel manner to a plane, plane 51, of the first component 12.

Figure 16:
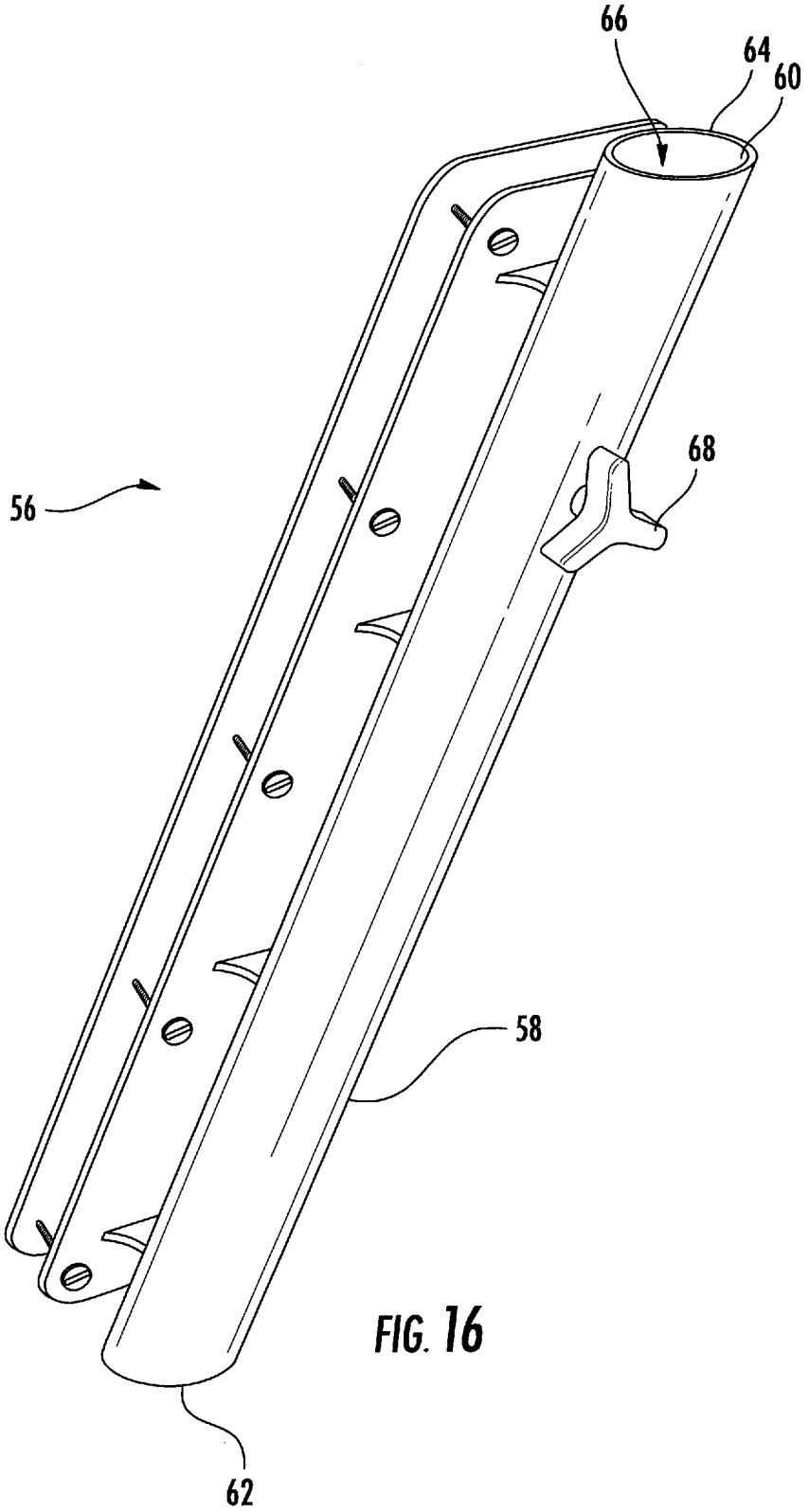
FIG. 16 is a front perspective view of an illustrative example of a support arm bracket assembly.
Figure 17:
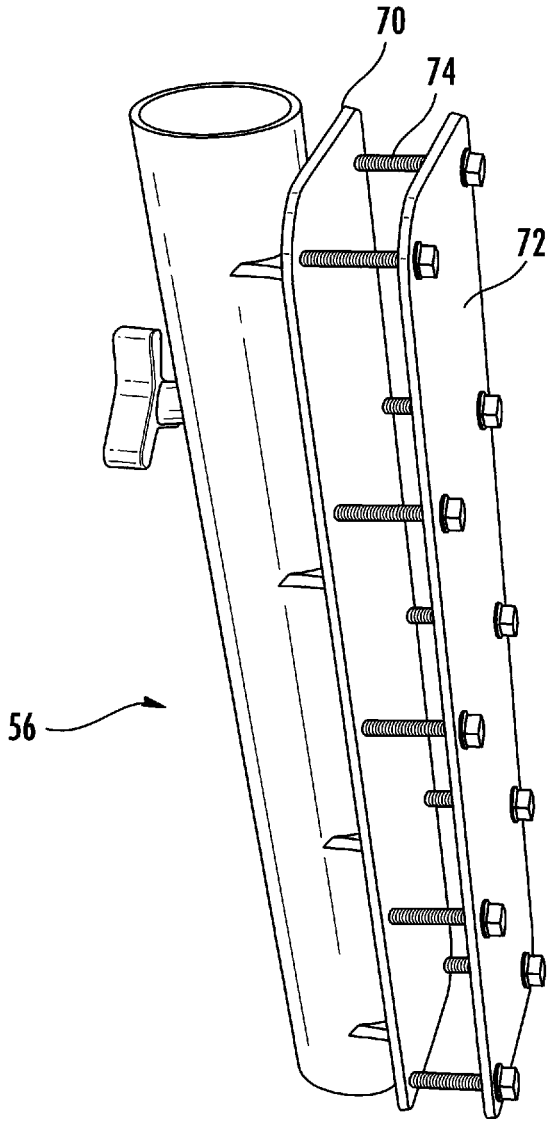
FIG. 17 is a back perspective view of an illustrative example of a support arm bracket assembly.
Figure 18:
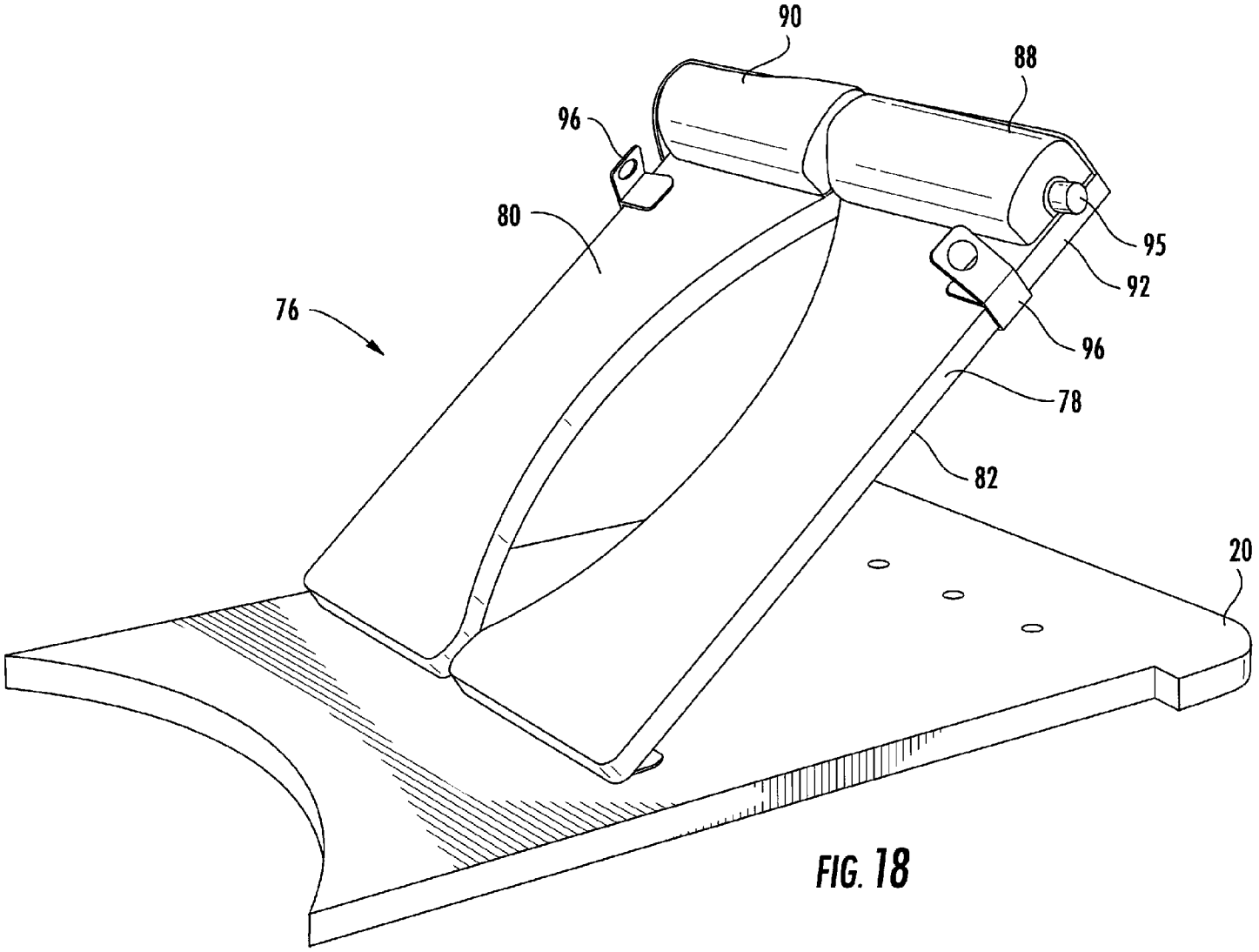
FIG. 18 is a perspective view of the foot pedal assembly.
Figure 19:
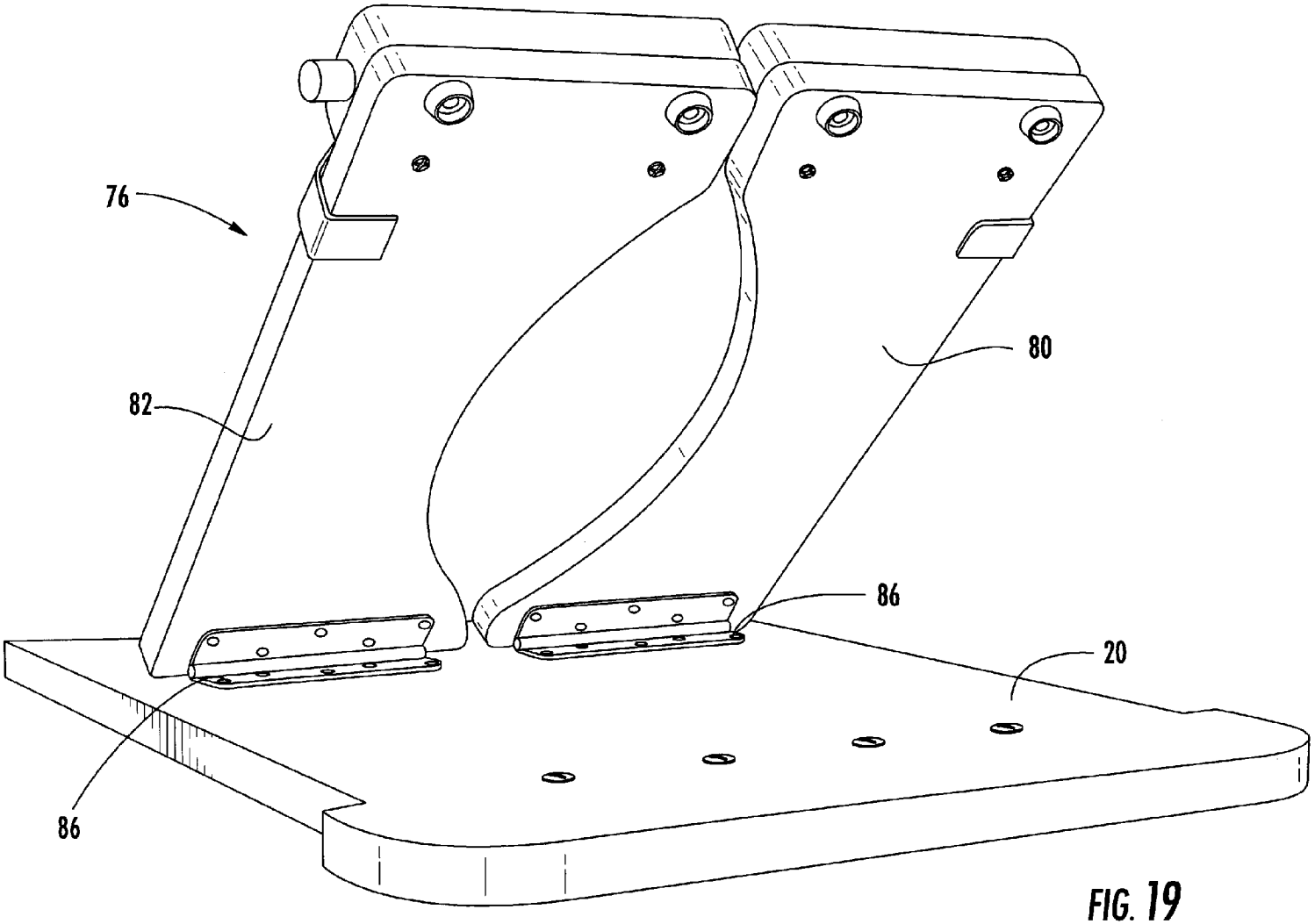
FIG. 19 is an alternative perspective view of the foot pedal assembly.
Figure 20:
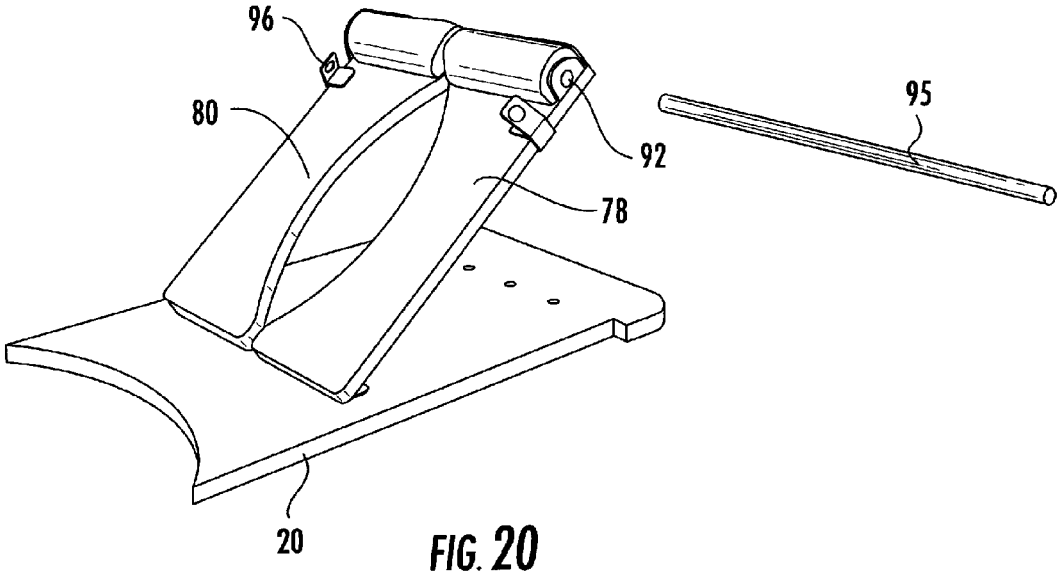
FIG. 20 illustrates an embodiment of the foot pedal assembly in which the foot pedals move simultaneously.
Figure 21:
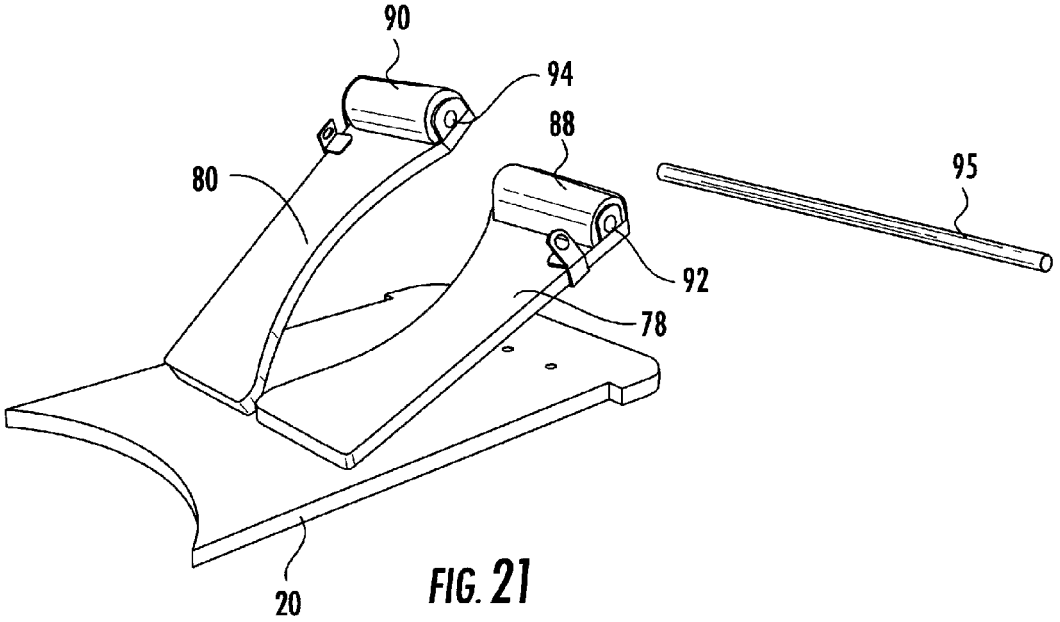
FIG. 21 illustrates an embodiment of the foot pedal assembly in which the foot pedals move independently.
Figure 22:
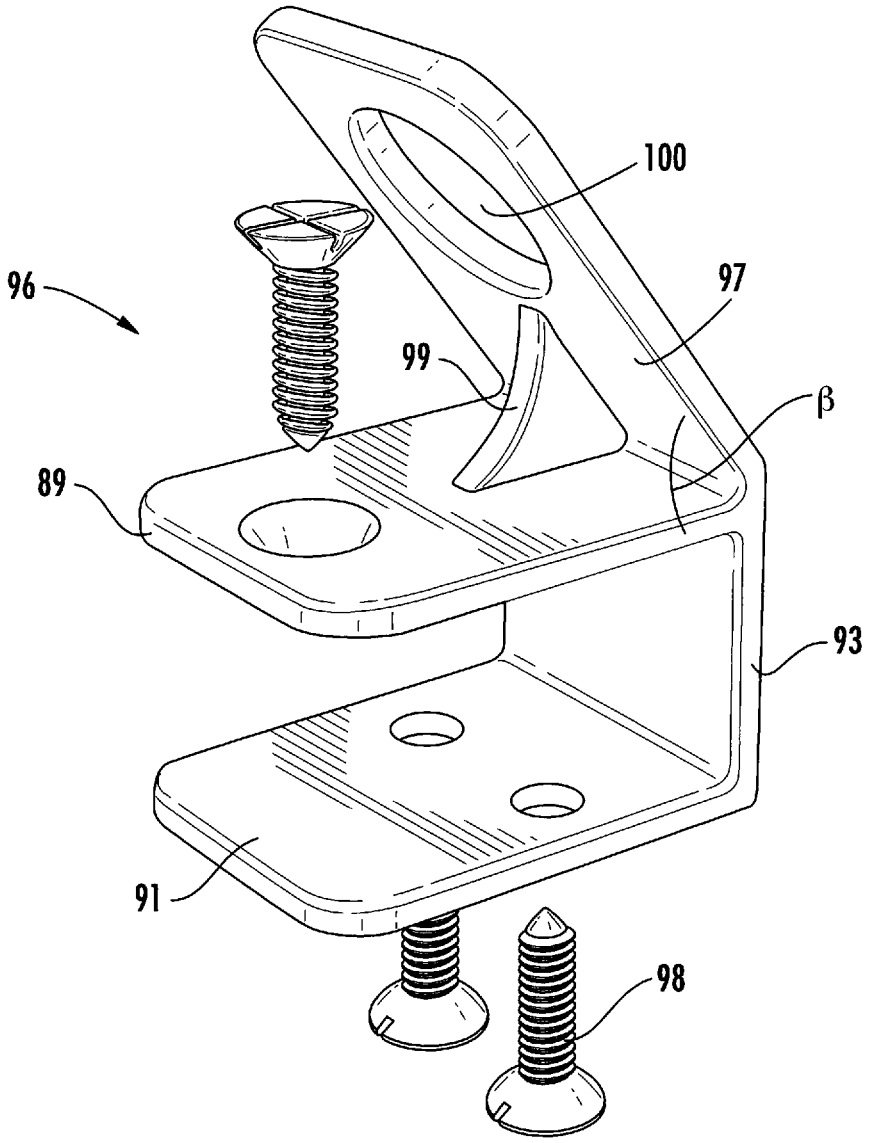
FIG. 22 is an illustrative example of a spring bracket.
Figure 23:
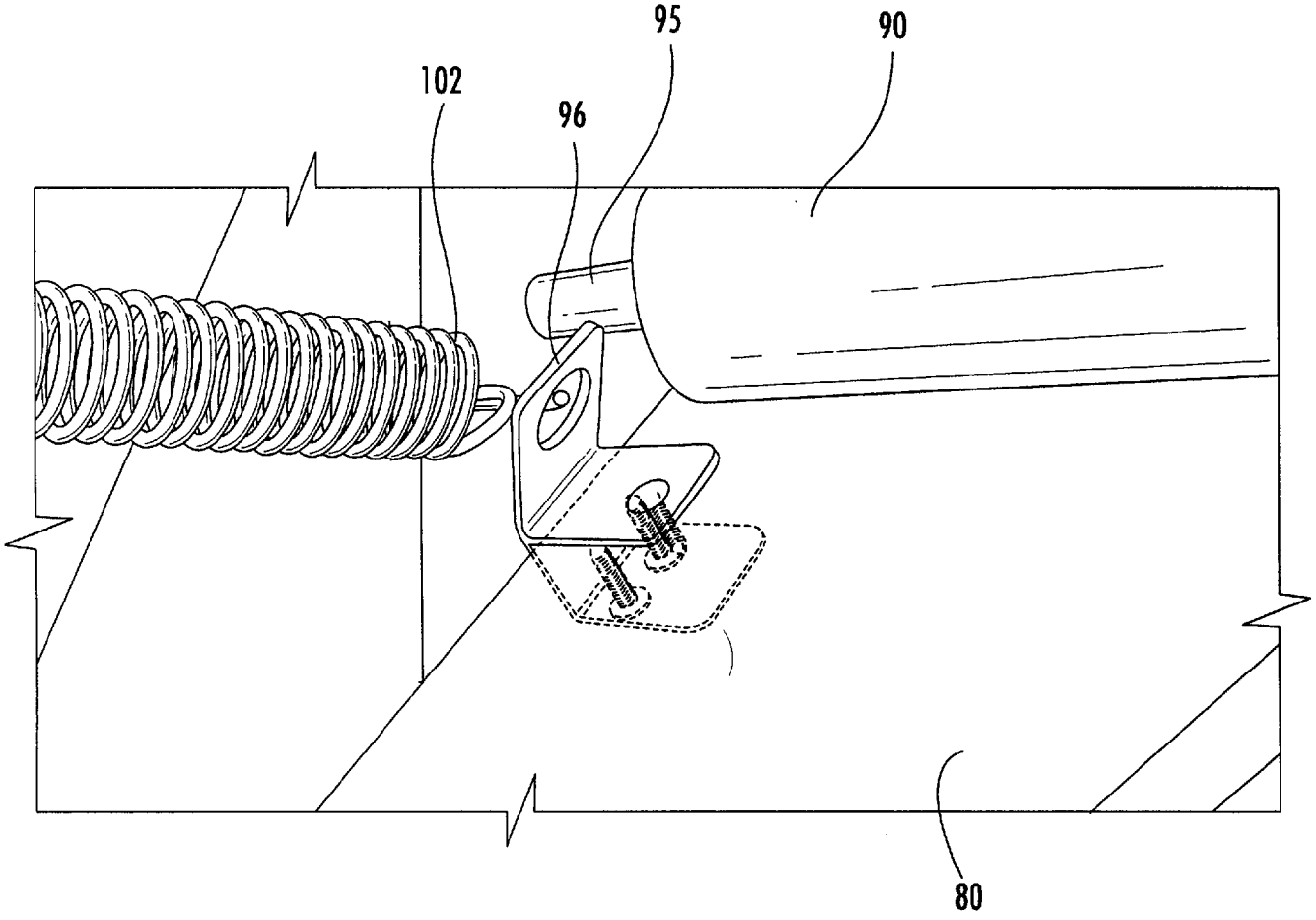
FIG. 23 is a partial view of the foot pedal assembly illustrating a spring attached to the spring bracket.
Figure 24:
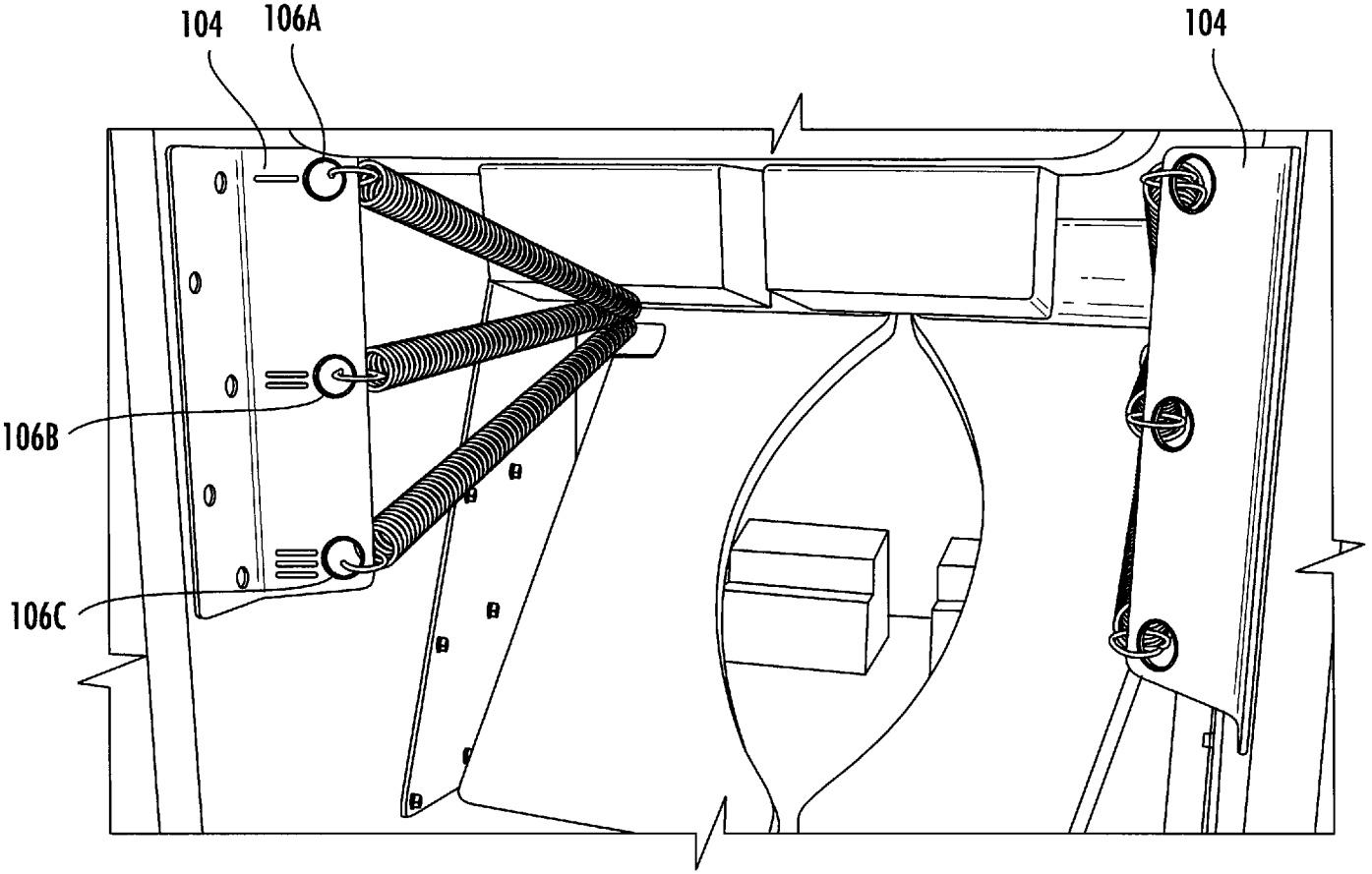
FIG. 24 is an alternative partial view of the foot pedal assembly illustrating the spring(s) coupled to plate bracket.

FIGS. 16-17 illustrate a side wall support arms bracket assembly 56 constructed and arranged to receive and hold a portion of the support arm 32 or 34. The side wall support arms bracket assembly 56 includes a side wall support arms bracket assembly main body 58, illustrated as an elongated sleeve member having a generally cylindrical shape. Each end 60 and 62 has an opening 64 to allow for the vertical member 32 or 34 to be inserted therein, resting within the side wall support arms bracket assembly main body interior 66. The vertical member 32 or 34 slidably engages within and can be fixed in place by a locking mechanism, illustrated herein as a knob 68 having a screw 70 (not shown) that interacts with one or more openings 72 (see FIGS. 11 and 12) within vertical members 32 or 34. Alternative locking mechanisms known to one of skill in the art can be used as well, including a spring pin. This allows the vertical member 32 or 34 to be height adjusted.

Attached to the side wall support arms assembly main body 58 is a first side wall support arms assembly plate 70. The first side wall support arms bracket assembly plate 70 is secured to the outer surface of the side wall 24 or 26. A second side wall support arms bracket assembly plate 72 secures to an inner surface of the side wall 24 or 26. A plurality of screws 74 secure the first side wall support arms bracket assembly plate 70 with the second side wall support arms bracket assembly plate 72, thereby locking the side wall support arms bracket assembly main body 58 in place. In the locked position, the horizontal bar 42 may be orientated in a plane above, and generally parallel to the upper surface 18. Alternatively, the side wall support arms assembly may be constructed to allow the arms to be pivotably secured to the side walls 32 or 34. In this embodiment, the arms 32 and 34 are rotated so that the horizontal bar 42 traverses from a first position, i.e. orientated in a plane above and generally parallel to the upper surface 18, to a second position in which the horizontal bar 42 is orientated in a plane below the upper surface 18, or any position in between.

To aid in providing resistant based Pilates exercises, the Pilates-Barre exercise device 10 may contain a foot pedal assembly designed to provide additional resistance and primary core strength training. The foot pedal assembly 76 is positioned within the interior 28 of the first component 12. Referring to FIGS. 18-24, the foot pedal assembly comprises a foot pedal plate 78 assembly having a left foot pedal plate 80 and a right foot pedal plate 82. The left foot pedal plate 80 and the right foot pedal plate 82 are hingedly connected to the bottom wall 20 through hinges 86. A pair of pads 88 and 90 is secured to the left foot pedal plate 80 and the right foot pedal plate 82 using screws. Preferably, the pads 88 and 90 are arranged about hollow tubes 92 and 94. A stainless steel rod 95 is inserted into the hollow tubes 92 and 94 to maintain the foot pedals 80 and 82 in an aligned position so that both move simultaneously. Alternatively, the steel rod 95 is not inserted therein and the foot pedals 80 and 82 are independently movable, see FIG. 21.

Each of the foot pedals 80 and 82 contain a spring bracket 96. The spring bracket is securable to the foot pedals 80 and 82 using screws 98. The spring bracket 96 contains two parallel plates 89 and 91 interconnected by plate 93 to form a generally U-shaped configuration. The U-shaped configuration allows the spring bracket 96 to be secured to the inner and outer surfaces of foot pedals 80 or 82. A fourth plate 97 extends outwardly and way from the first plate 91 at a predetermined angle β. The fourth plate may contain also contain gusset 99. The fourth plate 97 has opening 100 sized and shaped to receive one or more spring(s) 102. The spring(s) 102 attaches to a main body spring bracket 104. The main body spring bracket 104 is secured to the inner surface of the side walls 32 and 34. While the drawing shows three springs, preferably only one spring will be used per side. Changing the position of the spring relative to the openings 106A-106C changes the resistance provided.

Additional features may be included to enhance or to provide the user with additional features. The first component may also include an outer storage pouch 108 for holding exercise directions, see FIG. 3 and/or an inner storage compartment 110 for holding one or more weights 112, see FIG. 1. Magnetic blocks 114 (see FIG. 6) may be secured to inner storage compartment 110.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An exercise equipment apparatus for performing multiple exercises and/or workouts in a single apparatus comprising:

a first component for performing a first set of exercises, said first component comprising a top wall defining a upper surface, a bottom wall defining a bottom surface, a plurality of side walls separated by said top wall, said top wall, said bottom wall, and said plurality of said walls arranged together to form a partially enclosed structure having an interior area, said upper surface is positioned at a vertical distance from said bottom wall;

a second component for performing a second set of exercises whereby said second set of exercises being different from said first set of exercises, said second component comprising a first member having a first end secured to one side wall of said plurality of side walls, a second opposing end terminating in a first resistance member, and a first member main body therebetween, said first member main body defined by a first vertically directed section configured to extend above said top wall and a second horizontally directed section orientated to contour at least a portion of a side perimeter of said top wall; a second member having a first end secured to an opposing side wall of said plurality of side walls and a second opposing end terminating in a resistance member, and a second member main body therebetween, said second member main body defined by a first vertically directed section configured to extend above said top wall and a second horizontally directed section orientated to contour at least a portion of an opposing side perimeter of said top wall; and a crossbar having a first end secured to said resistance member associated with said second end of said first member and a second end secured to said resistance member associated with said second end of said second member; and a foot pedal assembly positioned within said interior area.

2. The exercise equipment apparatus for performing multiple exercises and/or workouts in a single apparatus according to claim 1 wherein said resistance member is a spring coil.

3. The exercise equipment apparatus for performing multiple exercises and/or workouts in a single apparatus according to claim 1 wherein said first member and said second member are configured to be adjustable.

4. The exercise equipment apparatus for performing multiple exercises and/or workouts in a single apparatus according to claim 1 wherein said first member and said second member have telescoping members.

5. The exercise equipment apparatus for performing multiple exercises and/or workouts in a single apparatus according to claim 1 wherein said interior of said first component contains a storage compartment.

6. The exercise equipment apparatus for performing multiple exercises and/or workouts in a single apparatus according to claim 1 wherein said first member and said second member each have a handle grip.

7. The exercise equipment apparatus for performing multiple exercises and/or workouts in a single apparatus according to claim 1 wherein said upper surface contains a cushion member.

8. The exercise equipment apparatus for performing multiple exercises and/or workouts in a single apparatus according to claim 1 wherein said first member and said second member are removeably attached to said first component.

9. The exercise equipment apparatus for performing multiple exercises and/or workouts in a single apparatus according to claim 1 wherein said foot pedal assembly contains a single foot bar.

10. The exercise equipment apparatus for performing multiple exercises and/or workouts in a single apparatus according to claim 9 wherein said single foot bar is traversable between a first position and a second position.

11. The exercise equipment apparatus for performing multiple exercises and/or workouts in a single apparatus according to claim 1 wherein said foot pedal assembly contains a plurality of individual foot bars.

12. The exercise equipment apparatus for performing multiple exercises and/or workouts in a single apparatus according to claim 11 wherein said plurality of individual foot bars move as a single unit.

13. The exercise equipment apparatus for performing multiple exercises and/or workouts in a single apparatus according to claim 11 wherein said plurality of individual foot bars move independently.

14. The exercise equipment apparatus for performing multiple exercises and/or workouts in a single apparatus according to claim 1 wherein at least one side wall contains a pocket, internal storage compartment, or combinations thereof.

15. The exercise equipment apparatus for performing multiple exercises and/or workouts in a single apparatus according to claim 1 wherein said first component is adapted to provide a plurality of Pilate's exercises and said second component is adapted to provide a plurality of Barre exercises.

16. The exercise equipment apparatus for performing multiple exercises and/or workouts in a single apparatus according to claim 1 wherein said second component comprises a locking mechanism to maintain said first and second members in a predetermined position.

* * * * *